US010859955B2

(12) United States Patent
Asaka et al.

(10) Patent No.: US 10,859,955 B2
(45) Date of Patent: Dec. 8, 2020

(54) IMAGE HEATING MEMBER HAVING A PARTING LAYER FORMED OF A FLUORINE-CONTAINING RESIN TUBE, IMAGE HEATING APPARATUS AND MANUFACTURING METHOD OF THE IMAGE HEATING MEMBER

(71) Applicant: CANON KABUSHIKI KAISHA, Tokyo (JP)

(72) Inventors: Akeshi Asaka, Kashiwa (JP); Naoki Akiyama, Moriya (JP); Hiroto Sugimoto, Toride (JP); Hiroki Muramatsu, Tokyo (JP); Yasuhiro Miyahara, Tokyo (JP); Noriaki Kobayashi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/715,080

(22) Filed: Dec. 16, 2019

(65) Prior Publication Data

US 2020/0209793 A1 Jul. 2, 2020

(30) Foreign Application Priority Data

Dec. 26, 2018 (JP) ..... 2018-241907

(51) Int. Cl.
*G03G 15/20* (2006.01)

(52) U.S. Cl.
CPC . *G03G 15/2057* (2013.01); *G03G 2215/2038* (2013.01)

(58) Field of Classification Search
CPC ..... G03G 15/2057
USPC ..... 399/329, 333
See application file for complete search history.

(56) References Cited

U.S. PATENT DOCUMENTS

| | | | | |
|---|---|---|---|---|
| 9,110,411 | B2 | 8/2015 | Akiyama et al. | |
| 9,235,174 | B2 | 1/2016 | Akiyama et al. | |
| 9,459,572 | B2 | 10/2016 | Akiyama et al. | |
| 9,588,471 | B2 * | 3/2017 | Matsumoto et al. | G03G 15/2057 |
| 9,671,731 | B2 | 6/2017 | Matsunaka et al. | |
| 9,891,565 | B1 | 2/2018 | Miyahara et al. | |
| 10,155,362 | B2 | 12/2018 | Takahashi et al. | |
| 2015/0309451 | A1 | 10/2015 | Akiyama et al. | |

FOREIGN PATENT DOCUMENTS

JP 2016-037597 A 3/2016

* cited by examiner

*Primary Examiner* — William J Royer
(74) *Attorney, Agent, or Firm* — Venable LLP

(57) ABSTRACT

An image heating member for heating an image formed on a recording material includes a base material, an elastic layer which contains a thermally conductive filler of 5 μm or more in average diameter and which is provided on the base material, and a parting layer which is provided on the elastic layer so as to contact the elastic layer and which is formed of a fluorine-containing resin tube provided on the elastic layer. The fluorine-containing resin tube has 3% or more in heat contraction rate with respect to a widthwise direction of the image heating member before and after the fluorine-containing resin tube is heated and left standing in an oven at 200° C. for 30 minutes.

10 Claims, 3 Drawing Sheets

IMAGE HEATING MEMBER HAVING A PARTING LAYER FORMED OF A FLUORINE-CONTAINING RESIN TUBE, IMAGE HEATING APPARATUS AND MANUFACTURING METHOD OF THE IMAGE HEATING MEMBER

FIELD OF THE INVENTION AND RELATED ART

The present invention relates to an image heating member (belt) for use with an image heating apparatus of an image forming apparatus of an electrophotographic type, and relates to the image heating apparatus including the image heating member and a manufacturing method of the image heating member.

The image forming apparatus of the electrophotographic type includes a fixing device for fixing a toner image on a recording material (hereinafter referred to as a sheet) by heating and pressing the toner image formed on the sheet. In this fixing device, fixing members such as a heating roller (heating belt) and a pressing roller (pressing belt) are provided, and a constitution in which these rollers (belts) perform a fixing process at a position (fixing nip) where these rollers press-contact each other.

As an example of the fixing device, there is a device of a belt (film) heating type. This device includes a heater as a heating member (heating source) including a heat generating resistor on a ceramic substrate. The device includes an endless fixing belt as a heating member rotating and travelling while including and contacting this heater. The device further includes a pressing roller (rotatable pressing member) as a nip forming member for forming a nip in press-contact with the fixing belt and for rotationally driving the fixing belt. In this belt heating type, lower thermal capacity and downsizing of the fixing belt can be realized, so that not only energy saving of the fixing device can be realized but also a time (warm-up time) required until a temperature of the fixing belt reaches a predetermined temperature enough to heat-fix the toner image can be shortened.

As a base material of the belt, a heat-resistant resin material such as polyimide, a metal material such as electroformed nickel or SUS, or the like is used. On such a base material of the belt or the roller, an elastic layer comprising a heat-resistant rubber such as a silicone rubber is provided. By providing the elastic layer, when the recording material such as paper on which toner (toner image) is transferred passes through a nip formed by press-contact of two fixing members, i.e., a heating member and a pressing member which oppose each other, the surface of the fixing member deforms along the toner image on the recording material due to flexibility of the rubber of the elastic layer and thus a contact area is increased, so that contact thermal resistance is reduced. As a result, the toner can be uniformly melted and fixed on the recording material, so that a good image with no fixing non-uniformity and with high glossiness can be obtained.

In such a fixing member, in order to ensure a parting property from the toner, a method of impregnating the surface of the elastic layer with silicone oil has been employed. However, in this method, in order to maintain the parting property, the silicone oil has to be replenished, and due to problems such as a load of user maintenance and an increase in system cost, a fixing member with no use of the silicone oil has been needed. Therefore, as the fixing member with no use of the silicone oil, a fixing member having a constitution in which a parting layer is formed on the surface of the elastic layer goes current mainstream. As a material constituting such a parting layer, fluorine-containing resin materials such as polytetrafluoroethylene (PTFE), a tetrafluoroethylene-perfluoroalkylvinyl ether copolymer (PFA) and a tetrafluoroethylene-hexafluoropropylene copolymer (FEP) have been used.

As a means for forming the parting layer in the above-described fixing member, in which the parting layer is formed on the surface of the elastic layer, i.e., in the fixing belt or the fixing roller, a method in which a dispersion (aqueous dispersion paint) or powdery paint, which contains the above-described fluorine-containing resin material as a main component is coated on the surface of the elastic layer and then the coating is heated to a melting point or more and is formed in a film (layer), or a method such that a fluorine-containing resin (principally PFA) tube separately manufactured by extrusion molding is coated on the surface of the elastic layer has been used.

In the case where the fluorine-containing resin tube is coated on the surface of the elastic layer, an inner surface of the fluorine-containing resin tube has been subjected to a sodium treatment, an excimer laser treatment, a liquid ammonia treatment or the like in advance, so that wettability (surface energy) is improved, and then the fluorine-containing resin tube is bonded to the surface of the elastic layer through an adhesive. Specifically, on a belt base material, an addition-curable silicone rubber elastic layer is prepared in advance in a cured state, and then onto an outer surface of the elastic layer, an addition-curable silicone rubber adhesive is applied. On this outer surface, the fluorine-containing resin tube is coated and then the adhesive is heat-cured, and thus bonded to and laminated on the elastic layer. A coating method is not particularly limited, but a method in which the addition-curable silicone rubber adhesive is coated as a lubricant on the elastic layer, a method in which the fluorine-containing resin tube is expanded from an outside and then is coated on the elastic layer, or the like method can be used. The addition-curable silicone rubber adhesive disposed between the silicone rubber elastic layer and the fluorine-containing resin tube is cured after an excessive part thereof is squeezed out and removed before heat-curing, so that the addition-curable silicone rubber adhesive is formed as an adhesive layer with a substantially uniform thickness between the elastic layer and the parting layer.

The elastic layer is low in thermally contraction rate when the silicone rubber is used alone. When the thermally contraction rate is low, it becomes difficult to effectively conduct heat from a heater to the recording material, so that there is a liability that an image defect such as image form non-uniformity due to insufficient heating is caused. For that reason, into the silicone rubber elastic layer, in order to enhance the thermally contraction rate, a high thermally conductive filler is mixed in general in an amount in a range in which proper flexibility and proper strength can be maintained.

On the other hand, the fluorine-containing resin parting layer and the silicone rubber adhesive are also low in thermally contraction rate, and therefore, it has been tried to mix therein the high thermally conductive filler, but it is difficult to mix the filler because of a large influence on functions (parting property and adhesive property) as a principal object. Further, as regards the parting layer and the elastic layer, with an increasing thickness thereof, flexibility of the resultant fixing belt in which these layers are laminated is more impaired, and therefore, it is not preferable from a viewpoint of contact thermal resistance with the recording material in addition to thermal resistance thereof.

Accordingly, it is desirable from a viewpoint of heating efficiency that the parting layer and the adhesive layer are formed in the layers to the extent possible within a range in which the objective functions can be maintained through a durable lifetime.

From viewpoint that the adhesive layer is formed in a thin layer to the extent possible, as a method of directly bonding the addition-curable silicone rubber elastic layer and the fluorine-containing resin tube to each other with no adhesive (primer), a method in which an inner surface of a fluorine-containing resin tube is subjected to plasma treatment with plasma-excited gas in which vinylalkoxy is introduced has been proposed (Japanese Laid-Open Application 2016-37597).

However, in the case where the fixing belt in which the silicone rubber elastic layer and the fluorine-containing resin tube are laminated without using the adhesive therebetween is used in the image heating apparatus, particularly at a non-sheet-passing portion when recording materials (papers) with the same size are continuously passed through the image heating apparatus, the parting layer (fluorine-containing resin tube) is liable to cause creases in a circumferential shape of the belt, so that a lifetime of the belt is shortened.

SUMMARY OF THE INVENTION

A principal object of the present invention is to provide an image heating member, an image heating apparatus and a manufacturing method of an image heating member, which are capable of suppressing a crease for a long term even in the case where an image heating member in which an elastic layer and a fluorine-containing resin tube are laminated without interposing an adhesive between the elastic layer and the fluorine-containing resin tube.

According to an aspect of the present invention, there is provided an image heating member for heating an image formed on a recording material, the image heating member comprising: a base material; an elastic layer which contains a thermally conductive filler of 5 μm or more in average diameter and which is provided on the base material; and a parting layer which is provided on the elastic layer so as to contact the elastic layer and which is formed of a fluorine-containing resin tube provided on the elastic layer, wherein the fluorine-containing resin tube has 3% or more in heat contraction rate with respect to a widthwise direction of the image heating member before and after the fluorine-containing resin tube is heated and left standing in an oven at 200° C. for 30 minutes.

Figure 3:
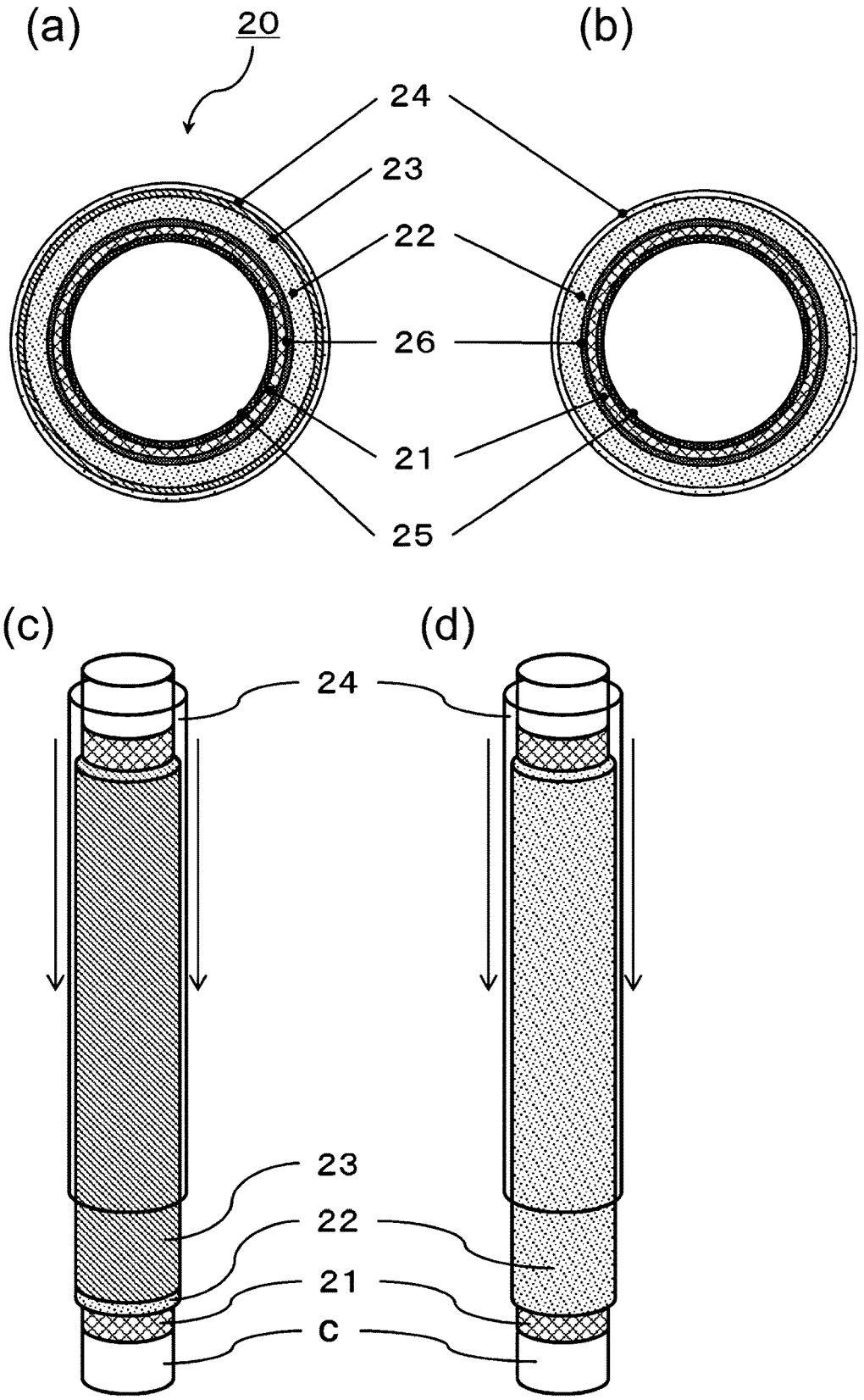

Parts (a) and (c) of FIG. 3 are schematic views for illustrating a structure of a fixing belt in a comparison example, and parts (b) and (d) of FIG. 3 are schematic views for illustrating a structure of a fixing belt in the embodiment of the present invention.

DESCRIPTION OF EMBODIMENTS

Embodiments of the present invention will be described with reference to the drawings.

[Image Forming Apparatus]

Figure 1:
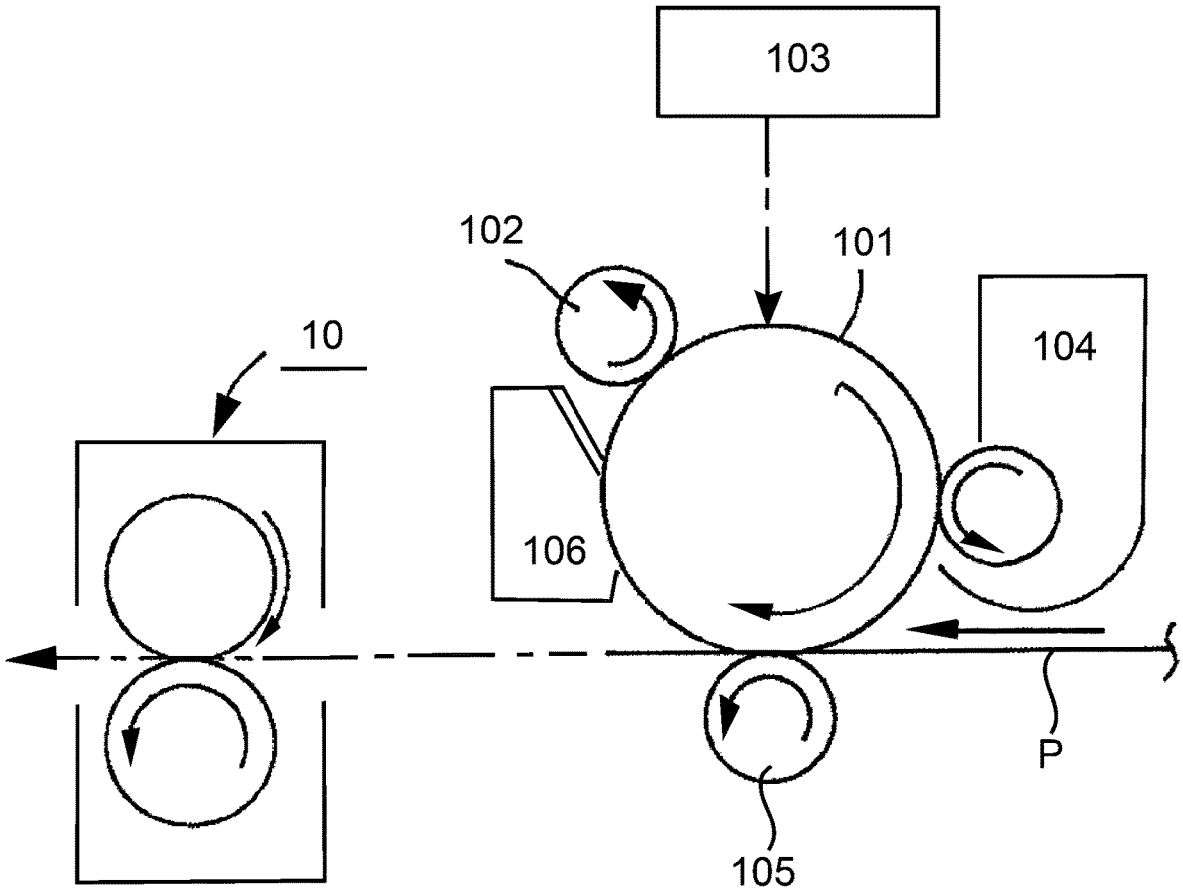
FIG. 1 is a schematic structural view of an example of an electrophotographic image forming apparatus.

FIG. 1 is a schematic structural view of an example of an image forming apparatus.

This image forming apparatus is an image forming apparatus of an electrophotographic type, and includes a rotatable electrophotographic photosensitive member 101. In the image forming apparatus, as a means for forming an electrostatic latent image on the photosensitive member 101, a charging device 102 and an image exposure means 103 are provided, and a developing means 104 for developing the electrostatic latent image, on the photosensitive member 101, into a toner image (developer image) is provided. The image forming apparatus includes a transfer means 105 for transferring the toner image from the photosensitive member 101 onto a sheet-shaped recording material (hereinafter referred to as paper or a sheet) P. The image forming apparatus further includes a cleaning means 106 for cleaning the surface of the photosensitive member 101 after toner image transfer, a fixing device 10 (FIG. 2) as a fixing means for fixing a toner image T on the sheet P, and the like means.

[Fixing Device]

Figure 2:
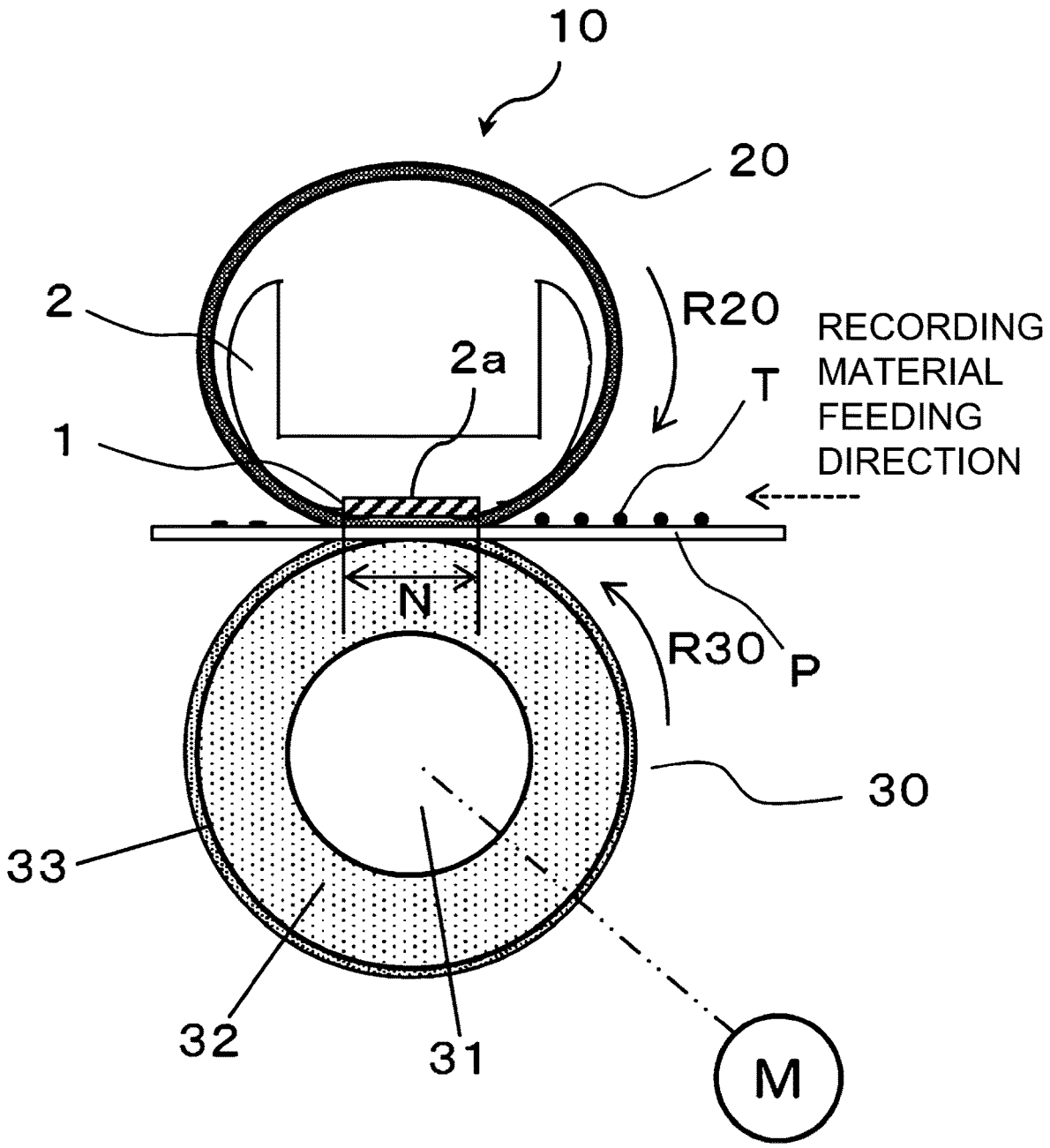
FIG. 2 is a schematic sectional view showing a structure of a fixing device according to an embodiment of the present invention.

FIG. 2 is a schematic cross-sectional view showing a general structure of the fixing device 10 in this embodiment.

In the following description, with respect to the fixing device and members constituting the fixing device, an axial direction is a direction perpendicular to a sheet feeding direction on a surface of the sheet. A length is a dimension with respect to the axial direction.

This fixing device 10 is a fixing device of a belt (film) heating type. The fixing device 10 includes a ceramic heater 1 and a film guide 2 also functioning as a heating member supporting member. Further, the fixing device 10 includes a fixing belt 20, as an image heating member (fixing member), which is endless (cylindrical) in shape and which has flexibility and a heat-resistant property. Further, the fixing device 10 includes a pressing roller 30 as a nip forming member for forming a nip (fixing nip) N in press-contact with the fixing belt 20.

The heater 1 is an elongated plate-like member extending along a longitudinal direction (direction perpendicular to the drawing sheet) of the fixing belt 20, and includes a heat generation source such as a heat generating resistor generating heat by energization thereto by an unshown energizing means, so that the fixing belt 20 abruptly increases in temperature. A temperature of the heater 1 is detected by an unshown temperature detecting means, and detection temperature information thereof is inputted to an unshown control means. The control means controls electric power supplied from the energizing means to the heat generation source so that a detection temperature inputted from the temperature detecting means is kept at a predetermined fixing temperature, and temperature-controls a temperature of the heater 1 to a predetermined temperature.

The heater 1 supported by the film guide 2 formed in a substantially semicircular trough shape in cross-section by a heat-resistant material having rigidity. Specifically, on an outer surface of the film guide 2, a groove portion 2*a* is provided along a longitudinal direction of the film guide 2, and the heater 1 is engaged in this groove portion 2*a*.

As described later, the fixing belt 20 includes, from an inside to an outside, a ring-shaped (cylindrical) base material 21, an elastic layer 22, a parting layer 24, and the like (FIG. 3). The fixing belt 20 is an endless film having an inner peripheral surface on which the heater 1 and the film guide 2 slide in a state of use, and is externally fitted around an outer periphery of the film guide 2 with a latitude in peripheral length.

The heater 1 is press-contacted to the fixing belt 20 toward the pressing roller 30, and the nip N is formed between the fixing belt 20 and the pressing roller 30. The pressing roller 30 is rotationally driven at a predetermined peripheral speed in the counterclockwise direction of an arrow R30 by a rotational driving device M such as a motor. By this rotational drive of the pressing roller 30, the fixing belt 20 is rotated in the clockwise direction of an arrow R20 around the film guide (holder) 2 while an inner surface thereof slides on the surface of the heater 1. Opposite end portions of the fixing belt 20 with respect to the longitudinal direction are rotatably supported by flanges (not shown) which are regulating (restricting) members fixed to the fixing device 10.

The holder 2 not only functions as a supporting member for the heater 1 but also functions as a rotation guide member for the fixing belt 20. Onto the inner peripheral surface of the fixing belt 20, a lubricant (grease) is applied in order to ensure a sliding property between the heater 1 and the holder 2.

The pressing roller 30 includes, from an inside to an outside, a base material 31 having a solid rod shape or a cylindrical (pipe) shape, or the like, and an elastic layer 32 and a parting layer 33. The pressing roller 30 is rotationally driven during use by the rotational driving device M such as the motor. For this reason, opposite end portions of the base material 31 with respect to an axial direction are rotatably supported via bearing members by an unshown fixing portion such as a frame of the fixing device 10.

Further, the pressing roller 30 is disposed at a position opposing the heater 1, supported by the film guide 2, with respect to the fixing belt 20. Further, by a pressing mechanism (not shown), predetermined pressure is applied to the pressing roller 30 and the fixing belt 20, so that the pressing roller 30 and the fixing belt 20 are press-contacted to each other, and thus the respective elastic layers (22, 32) are elastically deformed. As a result, between the pressing roller 30 and the fixing belt 20, the nip N with a predetermined width with respect to the sheet feeding direction (recording material feeding direction) is formed.

The press-contact of both of the fixing belt 20 as a heating member and the pressing roller 30 as the nip forming member may be realized by a constitution in which the pressing roller 30 is press-contacted to the fixing belt 20 and may also be realized by a constitution in which the fixing belt 20 is press-contacted to the pressing roller 30. Further, a constitution in which both the fixing belt 20 and the pressing roller 30 are press-contacted to each other with predetermined pressure may also be employed.

When the pressing roller 30 is rotationally driven by the rotational driving device M, in the nip N formed between the pressing roller 30 and the fixing belt 20 rotates by the pressing roller 30, the sheet P is fed while being nipped. Further, the fixing belt 20 is heated until the temperature of the surface of the fixing belt 20 reaches a predetermined temperature (for example, 200° C.). In the state, the sheet P carrying an unfixed toner image T thereon is introduced into the nip N and is nipped and fed, so that the unfixed toner image T is heated and pressed. Then, the unfixed toner image T is melted and color-mixed, and therefore then is cooled, so that the toner image is fixed as a fixed image on the sheet P.

[Fixing Belt]

Next, details of the fixing belt 20 in this embodiment will be described. Parts (a) and (c) of FIG. 3 are a schematic sectional view and a schematic perspective view, respectively, showing a layer structure of a fixing belt 20 which is a fixing member in a comparison example. Parts (b) and (d) of FIG. 3 are a schematic sectional view and a schematic perspective view, respectively, showing a layer structure of the fixing belt 20 which is the fixing member in this embodiment according to the present invention. In the figures, on the inner peripheral surface of the base material 21 (cylindrical base) of the fixing belt 20, an inner surface sliding layer 25 is formed. On an outer peripheral surface of the base material 21, a primer layer 26 is coated. The elastic layer 22 is disposed on the primer layer 26. The parting layer 24 is a fluorine-containing resin tube. In the comparison example shown in parts (a) and (c) of FIG. 3, the parting layer 24 is fixed to a peripheral surface of the elastic layer 22 through an adhesive layer 23. In this embodiment, the parting layer 24 is directly fixed to a peripheral surface of the elastic layer 22 without interposing the adhesive layer 23 between the parting layer 24 and the elastic layer 22.

In the following, the respective structural layers will be described.

1) Base Material 21

As the base material 21 of the fixing belt, in view of necessity of a heat-resistant property and a flex resistance, a heat-resistant resin material such as polyimide, polyamideimide or polyether ether ketone (PEEK) may suitably be used. Or, also in view of thermal conductivity, a metallic material such as stainless steel (SUS), nickel or a nickel alloy, which is higher in thermal conductivity than the heat-resistant resin material, may suitably be used. The base material 21 is required to be made high in mechanical strength while being made small in thermal capacitance, and therefore, a thickness thereof may desirably be 5-100 μm, preferably 20-85 μm. In this embodiment, a SUS material of 24 mm in inner diameter and of 30 μm in thickness is used as the base material 21.

2) Inner Surface Sliding Layer 25

As a material of the inner surface sliding layer 25, a resin material, such as polyimide resin material, possessing high durability and a high heat-resistant property in combination. In this embodiment, a polyimide precursor solution obtained by substantially equimolar reaction in an organic polar solvent between aromatic tetracarboxylic dianhydride or its derivative and aromatic diamine is applied onto the inner peripheral surface of the base material 21, and after the solvent is dried, a dried precursor is subjected to dewatering cyclization reaction (imidization) by heating, so that the inner surface sliding layer 25 is formed.

3) Elastic Layer 22

On the outer peripheral surface of the base material 21, the elastic layer 22 is provided through the primer layer 26. The elastic layer 22 uniformly imparts heat to unfixed toner T so as to cover the unfixed toner T on the sheet P. The elastic layer 22 thus functions, whereby a good image with high glossiness and with no fixing non-uniformity can be obtained. As a material of the elastic layer 22, from reasons such that processing easy with high accuracy and that reaction by-product does not generate during heat-curing, a liquid silicone rubber of an addition reaction cross-linking type may preferably be used. The liquid silicone rubber of the addition reaction cross-linking type may also contain, for example, organopolysiloxane and organohydrogenpolysiloxane and may further contain a catalyst and other additives. The organopolysiloxane is a base polymer using a silicone rubber as a source material and may preferably be 5,000-100,000 in number-average molecular weight and 10,000-500,000 in weight-average molecular weight.

The liquid silicone rubber is a polymer possessing flowability at room temperature, but is cured by heating and properly has low hardness after curing, and has a sufficient heat-resistant property and a deformation restoring force.

For that reason, the liquid silicone rubber may suitably be used not only in the belt elastic layer 22 but also in the elastic layer 32 of the pressing roller 30. Incidentally, if the elastic layer 22 is formed of the silicone rubber alone, thermal conductivity of the elastic layer 22 becomes low. When the thermal conductivity of the elastic layer 22 is low, heat generated by the heater 1 is not readily conducted to the sheet P through the fixing belt 20, and therefore, heating becomes insufficient when the toner image is fixed on the sheet P, so that an image defect such as fixing non-uniformity can occur. Therefore, in order to enhance thermal conductivity of the elastic layer 22, for example, a high thermal conductive filler having a granular shape is mixed and dispersed in the elastic layer 22.

As the high thermal conductive filler having the granular shape, silicon carbide (SiC), zinc oxide (ZnO), alumina ($Al_2O_3$), aluminum nitride (AlN), magnesium oxide (MgO), carbon (black), or the like is used. These materials can be used singly or in mixture of two or more kinds thereof. From viewpoints of handing and dispersion property, the high thermal conductive filler may preferably be 1 μm or more and 50 μm or less in average diameter. Further, a shape thereof may be a spherical shape, a pulverized shape, a needle shape, a plate shape, a whisker shape and the like shape, but may preferably be the spherical shape from the viewpoint of the dispersion property.

The thickness of the elastic layer 22 may desirably be 30-500 μm, preferably be 100-300 μm in order to obtain a good image by sufficient elasticity thereof and to suppress delay of a time, until a temperature reaches a predetermined temperature by heating, due to an increase in thermal capacity. In this embodiment, as the high thermal conductive filler, alumina was used, and the elastic layer 22 was 1.0 W/mK in thermal conductivity and was 300 μm in thickness.

4) Adhesive Layer 23

The adhesive layer 23 for fixing the fluorine-containing resin tube which is the parting layer 24 on the cured silicone rubber which is the elastic layer 22 was applied onto the surface of the elastic layer 22 in a thickness of 1-10 μm (adhesive application step of applying the adhesive onto the outer peripheral surface of the cylindrical elastic layer). In this embodiment, the adhesive layer 23 comprises a cured product of an addition-curable silicone rubber adhesive. The addition-curable silicone rubber adhesive 23 contains an addition-curable silicone rubber in which a self-adhesive component is contained. Specifically, the addition-curable silicone rubber adhesive 23 contains organopolysiloxane having an unsaturated hydrocarbon group represented by a vinyl group, and hydrogenorganosiloxane and a platinum compound as a cross-linking catalyst. This material is cured by addition reaction. As such an adhesive, a known adhesive can be used.

5) Parting Layer 24

As a material of a surface layer (toner parting layer) 24 of the fixing member, a fluorine-containing resin tube prepared by extrusion molding is used from viewpoints of a molding property and a parting property. As a fluorine-containing resin material, a tetrafluoroethylene-perfluoroalkylvinyl ether copolymer (PFA) may suitably be used (PFA tube). A type of a copolymerization of PFA as a source material is not particularly limited, and for example, it is possible to cite random polymerization, block polymerization, graft polymerization and the like. Further, a molar ratio of tetrafluoroethylene (TFE) and perfluoroalkyl vinyl ether (PAVE) in PFA as the source material is not particularly limited. For example, PFA having the TEE/PAVE molar ratio of 94/6-99/1 can suitably be used.

As other fluorine-containing resin materials, it is possible to cite a tetrafluoroethylene/hexafluoropropylene copolymer (FEP), polytetrafluoroethylene (PTFE), an ethylene/tetrafluoroethylene copolymer (ETFE), polychlorotrifluoroethylene (PCTFE), an ethylene/chlorotrifluoroethylene copolymer (ECTFE), polyvinylidene difluoride (PVDF), and the like. These fluorine-containing resin materials can be used singly or in combination of a plurality of kinds.

In this embodiment, a 20 μm-thick PFA tube prepared by extrusion molding was used. A tube inner surface in this embodiment has been subjected to plasma treatment with plasma-excited gas in which vinylalkoxysilane is introduced. On the other hand, a tube inner surface in a conventional example (comparison example) has been subjected to ammonia treatment in order to improve wettability with the adhesive.

Before a coating method of the PFA tube in this embodiment is described, a coating method in the conventional example will be described step by step.

(a) Adhesive Application Step

A base material W (25+21+26+22) is set (externally fitted) around a core C, and on an entire outer surface of the silicone rubber layer (elastic layer) 22 laminated on the base material W, the addition-curable silicone rubber adhesive (adhesive layer) 23 is applied by a ring coating method.

(b) Tube Insertion Step into Expansion Mold

Inside a tube expansion mold K having an inner diameter larger than an outer diameter of the base material W on which the silicone rubber layer 22 and the adhesive layer 23 are laminated, the PFA tube (parting layer) 24 is disposed (inserted).

(c) Opposite End Portion Holding Step

Opposite end portions of the PFA tube 24 disposed in the expansion mold K are held (supported) by holding (supporting) members (first and second gripping tools) Fu and Fl. Specifically, the PFA tube 24 is held by the holding member Fu at one longitudinal end portion and by the holding member Fl at the other longitudinal end portion.

(d) Vacuum Expansion Step

Then, by a moving mechanism (narrowing mechanism), a longitudinal length of the PFA tube 24 was narrowed (shortened) by a predetermined length acquired in advance. Specifically, the moving mechanism moves the holding members Fu and Fl placed in a state in which the PFA tube 24 is held, in a direction in which the holding members Fu and Fl approach each other so that a distance between the holding members Fu and Fl is narrowed by a predetermined length (distance). Thereafter, a gap portion between the outer surface of the PFA tube 24 and the inner surface of the expansion mold K is put in a vacuum state (negative pressure relative to atmospheric pressure). In a vacuum (5 kPa), the PFA tube 24 expands in a radial direction, so that the outer surface of the PFA tube 24 closely contacts the inner surface of the expansion mold K.

(e) Base Material W Insertion Step

The base material W (25+21+26+22+23) is inserted into the expansion mold K in which the PFA tube 24 is expanded. An inner diameter of the expansion mold K is not particularly limited if the inner diameter falls within a range in which the insertion of the base material W is smoothly carried out.

(f) Vacuum Break Step

After the base material W is disposed in the expansion mold K, the vacuum state of the gap portion between the outer surface of the PFA tube 24 and the inner surface of the expansion mold K is broken (the negative pressure relative to the atmosphere pressure is released). The vacuum is broken, whereby diameter expansion is released until the outer diameter of the PFA tube 24 is made equal to the base material W on which the silicone rubber layer 22 is laminated, so that the surfaces of the PFA tube 24 and the silicone rubber layer 22 are in an intimate contact state with the addition-curable silicone rubber adhesive 23 disposed therebetween.

(g) Elongation Step

Then, the PFA tube 24 is elongated in a longitudinal direction to a predetermined elongation rate by an elongation mechanism. Specifically, the elongation mechanism moves the holding members Fu and Fl in a direction in which the holding members Fu and Fl are moved away from each other so that a distance therebetween is increased by a predetermined length (distance). When the PFA tube 24 is elongated, the addition-curable silicone rubber adhesive 23 disposed between the PFA tube 24 and the silicone rubber layer 22 functions as a lubricant, so that the PFA tube 24 can be smoothly elongated.

(h) Clamping Step

In order to maintain the elongation rate of the PFA tube 24 in the longitudinal direction, and further, in order to prevent contraction of the PFA tube 24 with respect to the longitudinal direction in a heating step (j) described later, the opposite end portions (regions to be cut in a later step) of the silicone rubber layer 22 and the PFA tube 24 are adhesively bonded in parallel, i.e., are temporarily fixed. The longitudinal opposite end portions of the PFA tube 24 are heated by a clamping bit (heating mechanism) H1 in which a heater is incorporated, so that the addition-curable silicone rubber adhesive 23 is cured and thus the silicone rubber layer 22 and the PFA tube 24 are locally bonded adhesively. The clamping portion (temporarily fixed portion) at each of the longitudinal opposite end portions of the PFA tube 24 has a constitution in which a bonded portion to the silicone rubber layer 22 and a non-bonded portion to the silicone rubber layer 22 are alternately provided at a plurality of positions with respect to a circumferential direction.

(i) Squeezing Step

Between the silicone rubber layer 22 and the PFA tube 24, an excessive addition-curable silicone rubber adhesive 23 which does not contribute to the adhesive bonding and air involved during breakage of the vacuum exist. In this squeezing step, the excessive adhesive and air are squeezed out. First, the base material W coated with the PFA tube 24 is taken out of the expansion mold K. A ring-shaped member R provided with a ring-shaped slit with an inner diameter slightly larger than an outer diameter of the base material W is externally fitted around the base material W. Then, this ring-shaped member R is moved downward in the longitudinal direction of the PFA tube 24 from an upper end portion of the base material W coated with the PFA tube 24 while jetting air (air pressure: 0.5 MPa) through the slit. As a result, the excessive addition-curable silicone rubber adhesive 23, which does not contribute to the adhesive bonding, disposed between the silicone rubber layer 22 and the PFA tube 24, and the air involved during breakage of the vacuum are squeezed out. Incidentally, as a squeezing method, other than the method utilizing the air pressure, a liquid or a semisolid may also be jetted. Further, an expansion and contraction rubber ring having a diameter smaller than the outer diameter of the base material W coated with the PFA tube 24 may also be used for squeezing the PFA tube 24.

(j) Heating Process Step

After the squeezing step, a heating process (150° C., 20 min.) is carried out, so that an entirety (other than the clamping portion) of the addition-curable silicone rubber adhesive 23 is cured. As a result, the PFA tube 24 and the silicone rubber layer 22 are adhesively bonded to each other over an entire region.

(k) Secondary Curing

The fixing belt 20 in which the parting layer 24 is adhesively fixed to the peripheral surface of the elastic layer 22 through the adhesive layer 23 is secondary-cured by being left standing for 4 hours in an oven with circulating hot air at 200° C.

(l) Cutting and Abrasion Step

After the secondary curing by the heating process, the fixing belt 20 is naturally cooled (with air), the base material W (25+21+26+22+23+24) is cut by a predetermined length at each of opposite end sides. Specifically, a cutting mechanism cuts the base material W so that the longitudinal opposite end portions of the base material W, i.e., the temporarily fixed regions are separated from the base material W. Thereafter, cut surfaces are deburred by being abraded with an abrasive film, so that the fixing film (fixing belt) 20 is completed.

In the conventional example, the PFA tube 24 is coated by a series of the steps as described above, but in this embodiment, by using the PFA tube 24 having the surface subjected to plasma treatment with plasma-excited gas in which vinylalkoxysilane is introduced in advance, without using the addition-curable silicone rubber adhesive 23, it becomes possible to reduce the steps and to reduce thermal resistance resulting from the adhesive layer. In the following, a coating method of the PFA tube in this embodiment will be described while being compared with the coating method of the PFA tube in the conventional example.

(A) Adhesive Application Step

In this embodiment, this step is not needed. In place of non-use of the adhesive, the silicone rubber layer 22 laminated on the base material W is kept in a semi-cured state. The semi-cured state refers to a state in which an addition reaction cross-linking component in the liquid silicone rubber remains without being sufficiently consumed and can be obtained under a heat-curing condition of a low temperature and a short time. In this embodiment, the semi-cured state is formed by curing the liquid silicone rubber, applied on the base material, for 5 min. in the oven with the circulating hot air at 160° C.

(B) Tube Insertion Step into Expansion Mold K

The PFA tube 24 is disposed (inserted) inside the tube expansion mold K having the inner diameter larger than the outer diameter of the base material W on which the silicone rubber layer 22 is laminated.

(C) Opposite End Portion Holding Step

This step is the same as the step (c) in the conventional example.

(D) Vacuum Expansion Step

This step is the same as the step (d) in the conventional example.

(E) Base Material W Insertion Step

The base material W (25+21+26+22) set (externally fitted) around the core C in advance is inserted into the expansion mold K in which the PFA tube 24 is expanded. An inner diameter of the expansion mold K is not particularly limited if the inner diameter falls within a range in which the insertion of the base material W is smoothly carried out.

(F) Vacuum Break Step

After the base material W is disposed in the expansion mold K, the vacuum state of the gap portion between the outer surface of the PFA tube 24 and the inner surface of the expansion mold K is broken (the negative pressure relative to the atmosphere pressure is released). The vacuum is broken, whereby diameter expansion is released until the outer diameter of the PFA tube 24 is made equal to the base material W on which the silicone rubber layer 22 is laminated, so that the surfaces of the PFA tube 24 and the silicone rubber layer 22 are in an intimate contact state with each other.

(G) Elongation Step

In the step (g) in the conventional example, the PFA tube 24 can be elongated in a longitudinal direction to a predetermined elongation rate by an elongation mechanism in such a manner that the addition-curable silicone rubber adhesive 23 disposed between the PFA tube 24 and the silicone rubber layer 22 functions as a lubricant. On the other hand, in this embodiment, the addition-curable silicone rubber adhesive 23 is not used and thus the PFA tube 24 and the silicone rubber layer 22 are directly in intimate contact with each other, and therefore, the PFA tube 24 cannot be elongated. Accordingly, there is no need to perform the elongation step in this embodiment.

(H) Clamping Step

In order to prevent contraction of the PFA tube 24 with respect to the longitudinal direction in a heating step (j) described later, the opposite end portions (regions to be cut in a later step) of the silicone rubber layer 22 and the PFA tube 24 are adhesively bonded in parallel, i.e., are temporarily fixed. The longitudinal opposite end portions of the PFA tube 24 are heated by a clamping bit (heating mechanism) H1 in which a heater is incorporated, so that the addition-curable silicone rubber adhesive 23 is cured and thus the silicone rubber layer 22 and the PFA tube 24 are locally bonded adhesively. The clamping portion (temporarily fixed portion) at each of the longitudinal opposite end portions of the PFA tube 24 has a constitution in which a bonded portion to the silicone rubber layer 22 and a non-bonded portion to the silicone rubber layer 22 are alternately provided at a plurality of positions with respect to a circumferential direction.

(I) Squeezing Step

Between the silicone rubber layer 22 and the PFA tube 24, air involved during breakage of the vacuum exist. In this squeezing step, the air is squeezed out. First, the base material W coated with the PFA tube 24 is taken out of the expansion mold K. A ring-shaped member R provided with a ring-shaped slit with an inner diameter slightly larger than an outer diameter of the base material W is externally fitted around the base material W. Then, this ring-shaped member R is moved downward in the longitudinal direction of the PFA tube 24 from an upper end portion of the base material W coated with the PFA tube 24 while jetting air (air pressure: 0.5 MPa) through the slit. As a result, the air involved during breakage of the vacuum are squeezed out. Incidentally, as a squeezing method, other than the method utilizing the air pressure, a liquid or a semisolid may also be jetted. Further, an expansion and contraction rubber ring having a diameter smaller than the outer diameter of the base material W coated with the PFA tube 24 may also be used for squeezing the PFA tube 24.

(J) Heating Process Step

After the squeezing step, a heating process (200° C., 20 min.) is carried out, so that an entirety (the semi-cured region other than the clamping portion) of the silicone rubber layer 22 is cured. As a result, the PFA tube 24 and the silicone rubber layer 22 are adhesively bonded to each other over an entire region.

(K) Secondary Curing

The fixing belt 20 in which the parting layer 24 is adhesively fixed to the peripheral surface of the elastic layer 22 is secondary-cured by being left standing for 4 hours in an oven with circulating hot air at 200° C.

(L) Cutting and Abrasion Step

After the secondary curing by the heating process, the fixing belt 20 is naturally cooled (with air), the base material W (25+21+26+22+24) is cut by a predetermined length at each of opposite end sides. Specifically, a cutting mechanism cuts the base material W so that the longitudinal opposite end portions of the base material W, i.e., the temporarily fixed regions are separated from the base material W. Thereafter, cut surfaces are deburred by being abraded with an abrasive film, so that the fixing film (fixing belt) 20 is completed.

[Durability Evaluation of Fixing Belt]

In the following, evaluation of the fixing belts 20 prepared by the above-described two series of the steps will be described using embodiments 1 and 2 and comparison examples 1 and 2 which are described later.

Durability evaluation of the fixing belts 20 were performed by using the fixing device 10 of the belt heating type shown in FIG. 2 in which each of the fixing belts of the embodiments and the comparison examples. In a state in which pressure is about 156.8 N on one end side, i.e., total pressure is about 313.6 N (32 kgf), the fixing belt 20 was rotationally driven so that a surface movement speed (peripheral speed) of the pressing roller is 246 mm/sec. On the basis of whether or not a crease having a circumferential shape of the belt generates in the parting layer 24 (fluorine-containing resin tube) at a non-sheet-passing portion of the fixing belt 20 when sheets (A4 landscape) were continuously passed in a state in which a surface temperature of the fixing belt 20 at a sheet-passing portion was controlled at 170° C., "o" and "x" were evaluated. Specifically, when 5 sheets (SRA 3 paper or the like), having a larger width than the width of A4 (landscape) paper, on which a solid blue image of 1.0 [mg/cm$^2$] in toner application amount was formed were continuously passed after 300,000 sheets of the A4 (landscape)-size paper were passed, on the basis of whether or not fixing non-uniformity due to the crease occurred, "○" and "x" were evaluated. In a table 1 appearing hereinafter, the case where a fixing non-uniformity image was not generated on all the 5 sheets (SRA3 paper) was evaluated as "○", and the case where the fixing non-uniformity image was generated on even one sheet was evaluated as "x". In addition, the fixing belt 20 after 300,000 sheets (A4 landscape) were passed was taken out of the fixing device, and then, surface waviness Wt (maximum height in cross-section) of the parting layer at a crease generation portion (non-sheet-passing portion) was measured by a contact surface roughness meter. A result thereof is also shown in the table 1.

As the parting layers of all the fixing belts of the embodiments and the comparison examples, the PFA tubes 24 each having the inner surface subjected to the plasma treatment with the plasma-excited gas in which vinylalkoxysilane was introduced in advance were used without using the addition-curable silicone rubber adhesive 23.

The PFA tubes 24 are different in thermally contraction rate after molding by changing an extrusion molding condition. A value of the thermally contraction rate was calculated by the following calculation equation.

$$\text{Thermal contraction rate (\%)}=(1-La/Lb)\times 100$$

Here, Lb is a length, with respect to a longitudinal direction (rotational axis direction, width direction), of the PFA tube before heating, and La is a length (rotational axis direction, width direction) of the PFA tube after being heated and left for 30 min. in the oven with the circulating hot air at 200° C.

TABLE 1

| | TCR*1 (%) | CPW*2 (μm) | SIN*3 |
|---|---|---|---|
| EMB. 1 | 3.0 | 2.9 | ○ |
| EMB. 2 | 6.8 | 1.8 | ○ |
| COMP. EX. 1 | 1.6 | 5.0 | × |
| COMP. EX. 2 | −0.6 | 10.1 | × |

*1"TCR" is the thermally contraction rate of the PFA tube with respect to the rotational axis direction.
*2"CPW" is crease portion waviness.
*3"SIN" is solid image non-uniformity.

From the embodiments 1 and 2 and the comparison examples 1 and 2, it is understood that with a larger thermally contraction rate of the PFA tube, the surface waviness Wt (maximum height in cross-section) with generation of the crease becomes smaller and the image non-uniformity does not readily occur. In this embodiment, as regards the PFA tube with the thermally contraction rate of 3% or more, a degree of the solid image non-uniformity can be improved. This can be explained for the following reason.

First, the reason why the crease generates on the PFA tube at the non-sheet-passing portion is that the elastic layer (silicone rubber layer) is gradually softened and deteriorated due to non-sheet-passing portion temperature rise during continuous sheet passing. Thermal expansion coefficient is larger in the silicone rubber them in the PFA tube, and therefore, compression stress (stress toward a longitudinal central direction) is exerted on an interface between the PFA tube and the elastic layer during the sheet passing width heating. At the non-sheet-passing portion where softening and deterioration of the elastic layer advance, the PFA tube cannot withstand the compression stress and causes buckling and crease.

When the PFA tube large in thermally contraction rate with respect to the longitudinal direction (rotational axis direction) is used, the opposite end portions thereof are clamped (temporarily fixed) when the silicone rubber layer and the entirety (the semi-cured region other than the clamping portion) are cured and bonded, and therefore, tension is imparted to the PFA tube with thermal contraction with respect to the longitudinal opposite end portion directions. Accordingly, with a larger thermally contraction rate of the PFA tube, the compression stress (toward the longitudinal central direction) due to a difference in thermal expansion coefficient between the silicone rubber and the PFA tube can be canceled by the tension toward the longitudinal opposite end portion directions.

In this embodiment, the fixing belt for fixing the toner image on the recording material was described, but other than the fixing belt, the above-described constitution of the present invention is also effective in the pressing member such as a fixing roller, a pressing roller or a pressing belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-241907 filed on Dec. 26, 2018, which is hereby incorporated by reference herein in its entirety.

What is claimed is:

1. An image heating member for heating a toner image formed on a recording material, said image heating member comprising:

a base material;

an elastic layer which contains a thermally conductive filler of 5 μm or more in average diameter and which is provided on said base material; and a parting layer which is provided on said elastic layer so as to contact said elastic layer and which is formed of a fluorine-containing resin tube provided on said elastic layer, wherein said fluorine-containing resin tube has 3% or more in heat contraction rate with respect to a widthwise direction of said image heating member before and after said fluorine-containing resin tube is heated and left standing in an oven at 200° C. for 30 minutes.

2. The image heating member according to claim 1, wherein said parting layer formed of the fluorine-containing resin tube comprises a tetrafluoroethylene-perfluoroalkylvinyl ether copolymer.

3. The image heating member according to claim 1, wherein said elastic layer is an addition-curable silicone rubber elastic layer.

4. The image heating member according to claim 1, which is a fixing belt configured to fix the toner image on the recording material.

5. The image heating apparatus according to claim 1, which is a pressing member configured to form a nip in which the recording material is nipped and fed.

6. An image forming apparatus for heating a toner image formed on a recording material, said image heating apparatus comprising:

a rotatable film configured to fix the toner image, formed on the recording material, on the recording material;

a heater contacting an inner surface of said film; and a pressing member configured to press said heater through said film and to form a nip in which the recording material is nipped and fed, wherein said film comprises:

i) a base material;

ii) an elastic layer which contains a thermally conductive filler of 5 μm or more in average diameter and which is provided on said base material; and iii) a parting layer which is provided on said elastic layer so as to contact said elastic layer and which is formed of a fluorine-containing resin tube provided on said elastic layer, wherein said fluorine-containing resin tube has 3% or more in heat contraction rate with respect to a widthwise direction perpendicular to a feeding direction of the recording material before and after said fluorine-containing resin tube is heated and left standing in an oven at 200° C. for 30 minutes.

7. A manufacturing method of an image heating member, including a base material, an elastic layer provided on the base material, and a parting layer provided on the elastic layer and formed of a fluorine-containing resin tube, for heating an image formed on a recording material, said manufacturing method comprising:

a first step of semi-curing the elastic layer;

a second step of coating, after said first step, the fluorine-containing resin tube subjected at an inner surface to plasma treatment with plasma-exciting gas in which vinylakoxysilane is introduced in advance in a state in which a diameter of the fluorine-containing resin tube is increased so as to be larger than an outer diameter of the elastic layer;

a third step of heating, after said second step, only opposite end portions of the elastic layer and the fluorine-containing resin tube to cure and bond the elastic layer and the fluorine-containing resin tube;

a fourth step of squeezing, after said third step, air involved between the elastic layer and the fluorine-containing resin tube; and a fifth step of heating, after said fourth step, an entirety to cure and bond the elastic layer and the fluorine-containing resin tube at portions other than the opposite end portions.

8. The manufacturing method according to claim 7, wherein said parting layer formed of the fluorine-containing resin tube comprises a tetrafluoroethylene-perfluoroalkylvinyl ether copolymer.

9. The manufacturing method according to claim 7, wherein said elastic layer is an addition-curable silicone rubber elastic layer.

10. The manufacturing method according to claim 7, wherein said parting layer comprises a tetrafluoroethylene-perfluoroalkylvinyl ether copolymer, and has 3% or more in thermally contraction rate at 200° C. with respect to a rotational axis direction.

* * * * *